US007188940B2

(12) United States Patent
Feliciano

(10) Patent No.: US 7,188,940 B2
(45) Date of Patent: Mar. 13, 2007

(54) VENT PLUG METHODS AND APPARATUS

(75) Inventor: Ari Feliciano, Mayaguez, PR (US)

(73) Assignee: Hewlett-Packard Development Company, LP., Houston, TX (US)

( * ) Notice: Subject to any disclaimer, the term of this patent is extended or adjusted under 35 U.S.C. 154(b) by 348 days.

(21) Appl. No.: 10/356,779

(22) Filed: Jan. 31, 2003

(65) Prior Publication Data

US 2004/0150699 A1 Aug. 5, 2004

(51) Int. Cl.
*B41J 2/175* (2006.01)

(52) U.S. Cl. ..... 347/87

(58) Field of Classification Search ..... 347/85, 347/86, 87; 428/243; 293/120
See application file for complete search history.

(56) References Cited

U.S. PATENT DOCUMENTS 3,886,863 A * 6/1975 Carabott et al. ..... 101/125
5,549,324 A * 8/1996 Labrie et al. ..... 280/728.3
5,949,461 A * 9/1999 Jones et al. ..... 347/87
5,963,237 A * 10/1999 Ikkatai et al. ..... 347/85
6,158,848 A * 12/2000 Liu ..... 347/85
6,221,484 B1 * 4/2001 Leiter ..... 428/343
6,406,078 B1 * 6/2002 Wycech ..... 293/120
6,676,253 B2 * 1/2004 Hsu et al. ..... 347/86
2004/0056935 A1 * 3/2004 Matsushita et al. ..... 347/86
2004/0161282 A1 * 8/2004 Bolton ..... 401/35

FOREIGN PATENT DOCUMENTS

EP 1 279510 A1 * 1/2003 ..... 2/175

* cited by examiner

*Primary Examiner*—Anh T. N. Vo

(57) ABSTRACT

Apparatus include a liquid container body defining a reservoir and having a vent aperture defined therethrough, and a quantity of expandable foam disposed within the aperture. The cured expandable foam can act as a vent plug to prevent liquid from leaking out of the container body through the aperture, while also allowing air or other such gases to pass through the aperture for venting of the reservoir. Methods include steps of installing a plug into a vent aperture defined through a liquid container body. The steps can consist of dispensing a quantity of expandable foam into the vent aperture.

28 Claims, 5 Drawing Sheets

VENT PLUG METHODS AND APPARATUS

BACKGROUND OF THE INVENTION

Various containers and containment means are known in the art. Many such containers and containment means require venting. The concept of venting a container or containment means is well known in the art and entails allowing gas, such as atmospheric air, to enter and/or exit the container or containment means in order to prevent extreme pressure differentials across the container structure. That is, venting is a way of stabilizing the pressure within the container and/or containment means.

For example, many containers are configured to contain a liquid product. Examples of such liquids for which containment means are used include liquid fuel, liquid ink, pesticides, fertilizer, etc. In many instances, the liquid level within a container changes over time. For example, as the liquid product is used up, the liquid level within the respective container will fall. Conversely, when the liquid product is replenished, the liquid level will rise.

Typically, such liquid containers are configured to be substantially airtight in order to prevent leakage of the liquid contents. However, due to changing liquid levels within the container, venting of the container must be provided in many instances to facilitate proper functioning of the container and related systems, as well as to prevent structural damage to the container.

As mentioned above, liquid ink is an example of the type of liquid product for which containment means are employed. Various types of liquid ink containment means are employed in the art. One example of a liquid ink containment means is an inkjet pen of an inkjet printer. Typical inkjet printers, or imaging devices, include at least one pen that is configured to cyclically traverse the width of a printable surface such as a sheet of paper.

The pen includes a print head having an array of very small printing orifices through which droplets of ink can be selectively projected, or "fired," during movement of the pen in order to generate a desired pattern or image on the printable surface. The pen also typically includes a body that defines an enclosed ink reservoir that is configured to contain a supply of ink. Other printer formats can employ a fixed remote ink reservoir that supplies ink to a movable pen by way of a flexible tube or the like. In such cases, for the purposes of this disclosure, the remote reservoir is considered part of the pen.

Many inkjet printing systems employ pens with rigid bodies. In such cases, the ink supply reservoirs are typically vented to admit air in order to compensate for the volume of ink that is consumed during printing. Such venting prevents the development of a partial vacuum within the reservoir that can inhibit further firing of ink from the pen. In addition, such venting also allows equalization of pressure differentials caused by changes in temperature and atmospheric pressure. For example, without a vent, ambient pressure can fall below the internal reservoir pressure, thereby forcing ink out of the printing orifices, resulting in associated problems.

Conventional ink reservoirs are normally vented by way of an aperture defined in the pen body. Typically, a small cylindrical vent plug is inserted into the aperture. The plug usually has a grooved exterior surface that provides an elongated narrow air path that facilitates gradual equalization of pressure differences with respect to the reservoir. The air path provided by the groove is relatively long and narrow enough to prevent significant air exchange in an atmospherically stable environment, thereby minimizing evaporation and drying of the ink in the reservoir.

Such vent plugs are generally formed in the shape of a headless threaded machine screw having a helical, "V"-shaped groove, although other groove shapes and/or paths are known including serpentine paths and the like. For example, a vent plug having a serpentine groove path is disclosed in U.S. Pat. No. 6,273,562 to Deshmukh. A conventional vent plug is typically fabricated from a plastic-type of material such as nylon. The sharp vertices of the area between adjacent grooves are intended to crush slightly upon installation in order to provide a tight fit of the vent plug within the aperture.

While generally effective for facilitating the venting of inkjet pen reservoirs, various problems can be associated with existing vent plug configurations. For example, relatively precise alignment of the vent plug with the aperture is required for installation, and associated production difficulties are occasionally experienced, including misaligned plugs.

Similarly, such precise alignment and registration of the plug and vent aperture during installation generally requires relatively complex production machinery which often needs frequent maintenance and adjustment. Furthermore, the dimensional tolerances of the vent plug and the aperture are ideally relatively precise in order to achieve the desired press-fit of the plug. Such precise tolerances can present further associated production difficulties because of the relatively high degree of effort needed to achieve the tolerances.

Generally, a convenient way of providing a vent plug for any of a number of various liquid product containment means can be beneficial.

SUMMARY OF THE INVENTION

In accordance with one embodiment of the present invention, an inkjet pen includes a body that defines an enclosed reservoir that is configured to contain a liquid ink. A print head can be operatively supported by the body. The body defines a vent aperture therethrough, which is configured to provide venting of the reservoir. The ink-jet pen also includes a quantity of expandable foam that is disposed within the aperture. The expandable foam can act as a vent plug to substantially prevent ink from flowing out of the vent aperture while also allowing air to flow through the vent aperture for venting of the reservoir.

DETAILED DESCRIPTION OF THE INVENTION

Various embodiments of the present invention relate to apparatus and methods for plugging a vent aperture defined in the body of an inkjet pen. Apparatus in accordance with at least one embodiment of the present invention include a quantity of expandable foam that is dispensed into the vent aperture and allowed to cure therein, forming a vent aperture plug that can prevent liquid ink from passing therethrough and escaping, but can also allow air, or other gases, to pass therethrough to allow venting of the ink reservoir of the inkjet pen. Methods in accordance with the present invention include steps for plugging a vent aperture of an inkjet pen, and specifically can include dispensing expandable foam into the vent aperture.

Figure 1:
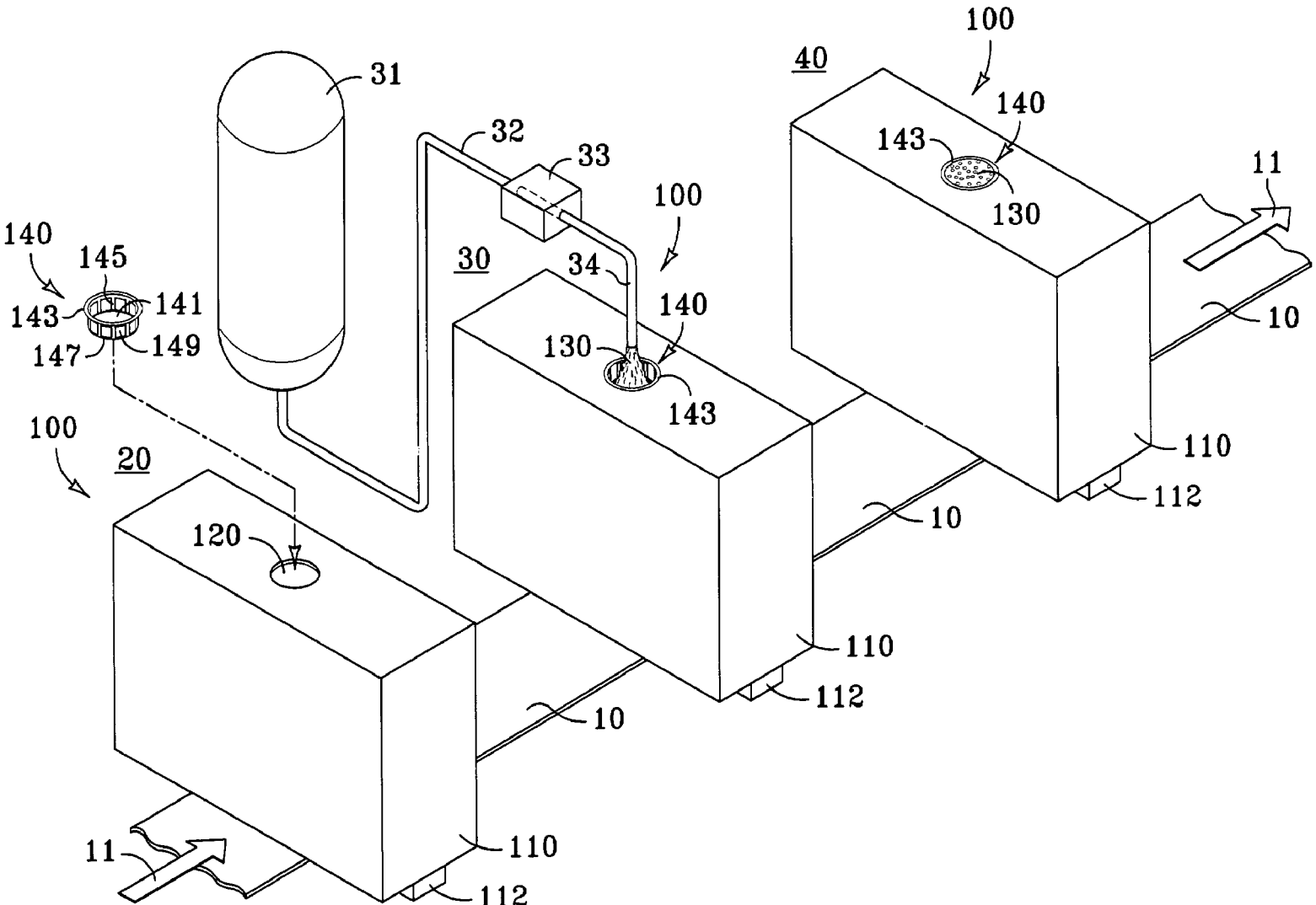
FIG. 1 is an isometric view in which a plurality of inkjet pens is depicted in accordance with one embodiment of the present invention.

Turning now to FIG. 1, an isometric view is shown in which an inkjet pen 100 in accordance with at least one embodiment thereof is depicted. It is noted that, for illustrative purposes, three inkjet pens 100 are depicted in FIG. 1 in various stages of assembly. The inkjet pen 100 includes a body 110 and a print head 112 that can be supported by the body. The body 110 defines an enclosed reservoir (not shown) that is configured to contain a quantity of liquid ink (not shown) as is described below in greater detail. The print head 112 is configured to draw the ink from the reservoir, and is further configured to selectively fire droplets of ink in the manner of conventional print heads which are known in the art and which are explained above with respect to the prior art.

It is understood that the discussion herein concentrates on inkjet pens as an illustrative example of but one specific application of the present invention. That is, while the various embodiments of the invention are discussed and depicted herein with respect to inkjet pens, it should be understood that such discussion and depiction of the various embodiments of the present invention are not intended to limit the application of the invention to inkjet pens alone. Contrarily, the invention is intended to be applicable to any liquid container requiring venting.

Still referring to FIG. 1, the body 110 defines a vent aperture 120 therethrough. A quantity of expandable foam 130 is disposed within the aperture 120, thereby substantially preventing the flow therethrough of liquid ink, while allowing vent air to flow therethrough. The term "expandable foam" as used herein is defined as any product that is configured to be dispensed from a storage container in a substantially flowable form, wherein, once dispensed, both expands and then cures into a substantially rigid form. Furthermore, the term "expandable foam" is intended to include various known products that are generally referred to in the industry as "expanding foam."

The expandable foam 130 can include at least a portion of open cell content and can also be substantially entirely open cell content, depending upon the desired air flow rate therethrough. The term "open cell" generally refers to a type of foam in which the foam structure is generally open, and which generally consists of a "lattice work" of material that defines a network of passageways throughout the foam. Conversely, the term "closed cell" generally refers to a type of foam in which the foam structure generally consists of a matrix of enclosed chambers or "bubbles."

Thus, the more the open cell content of the expandable foam 130, the higher the airflow rate capacity therethrough, in general. Also, if the passageways defined in the foam are small enough, liquid will tend not to flow therethrough while still allowing gas to flow therethrough. The expandable foam 130 can include polyurethane foam. One example of expandable foam that is presently available is marketed under the name, "Minimal Expanding Foam Sealant," and is available from Geocel®, P.O. Box 398, Elkhart, Ind. 46515. Another example is sold under the name, "Touch-n-Foam®," and is available from Convenience Products, 866 Horan Drive, Fenton, Mo. 63026.

As is further seen from an examination of FIG. 1, the inkjet pen 100 can include a support member 140. One of the functions of the support member 140 is to support the expandable foam 130 within the aperture 120 while the expandable foam is curing, and/or expanding as is further explained below. A further function of the support member is to facilitate the securing of the expanding foam 130 within the aperture 120 as is also further explained below. The support member 140 can have a support surface 141 defined thereon, on which the expandable foam 130 can be supported.

The support member 140 can have any of a number of possible configurations. For example, the support member 140 can be configured in the manner of a small basket as is depicted in FIG. 1. Specifically, the support member 140 can include a substantially annular rim 143 that is configured to rest on the body 110 proximate the aperture 120 and substantially outside of the reservoir. That is, the rim 143 can be configured so as to be slightly larger then the aperture 120 so that the majority of the support member 140, when inserted into the aperture as depicted, can be suspended within the reservoir while the rim substantially supports the support member by resting on the body 110 outside of the reservoir.

In the specific configuration thus considered above, the support member 140 can also include a deck 147. The deck 147 and the rim 143 can be oriented in spaced-apart, juxtaposed relation to one another such that, when the support member 140 is inserted into the aperture as shown and as described above, the deck is located substantially within the reservoir. The support member 140 can also include at least one stave element 145 which is connected to both the rim 143 and to the deck as shown.

An opening 149 is defined between the rim 143 and the deck 147. The opening 149 can also be bounded by the stave element 145 as is depicted. The opening 149 is configured to allow the expanding foam 130 to expand therethrough as is explained in greater detail below. When a plurality of stave elements 145 are included, a plurality of openings 149 are defined, wherein each opening is defined between two adjacent stave elements.

Still referring to FIG. 1, a process of installing the expandable foam 130 into the inkjet pen 100 can be illustrated. That is, as is seen from a study of FIG. 1, a conveyance device 10 can be employed to move a plurality of inkjet pens 100 generally in the direction indicated by the arrows marked 11. Each of the inkjet pens 100 can be consecutively moved first past an insertion station 20. At the insertion station 20, a support member 140 can be inserted into the aperture 120 of a given inkjet pen 100 as the pen moves past the insertion station.

After moving through the dispensing station 20, the given inkjet pen 100 can be moved by the conveyance device 10 past a dispensing station 30. At the dispensing station 30, the expandable foam 130 can be dispensed into the aperture 120 of the given inkjet pen 100. For example, a storage container 31 can be employed to contain a quantity of expandable foam 130 in a flowable state. A pipe 32, or other such foam distribution means, can be employed to carry the flowable expandable foam 130 from the storage container 31 to a valve 33. A nozzle 34 can also be employed to direct the expandable foam 130 into the aperture 120 of the given inkjet pen 100, wherein the valve 33 is selectively operated in a manner whereby a desired quantity of expandable foam is dispensed into the aperture.

The conveyance device 10 can then move the given inkjet pen 100 to a trimming station 40 where the cured expandable foam 130 can be trimmed as is further explained below. It is noted that the trimming procedure can be enhanced by ensuring that sufficient distance exists between the dispensing station 30 and the trimming station 40, thus allowing sufficient time for the expandable foam 130 to expand and cure, or harden. A suitable trimming means (riot shown), such as a blade or the like, can be employed at the trimming station 40 to trim the expandable foam 130 as is further explained below.

The inkjet pen 100, as well as one method of installing the expandable foam 130 therein, can be described from another perspective in conjunction with a study of FIGS. 2 through 5. Specifically, with reference to FIG. 2, a side elevation sectional view is shown in which the inkjet pen 100 in accordance with one embodiment of the invention is depicted. As is mentioned above, it is seen that the inkjet pen 100 includes a body 110 that defines an enclosed reservoir 115 that is configured to contain a volume of liquid ink 60. The body 110 of the inkjet pen 100 also defines therethrough a vent aperture 120. A print head 112, that can also be included in the inkjet pen 100, and can be operatively supported by the body 110 as depicted.

Figure 2:
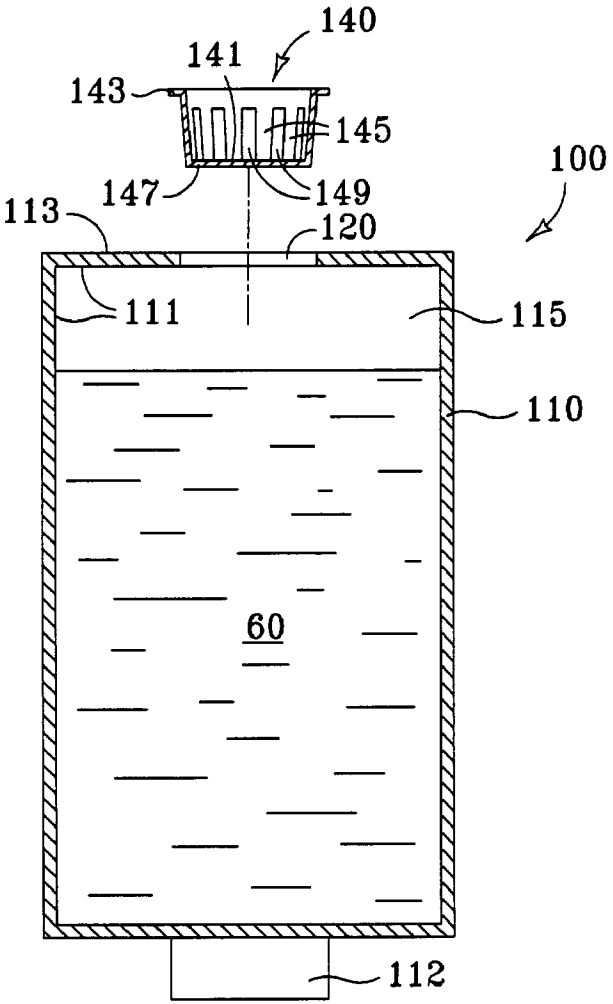
FIG. 2 is a side elevation sectional view of one of the inkjet pens depicted in FIG. 1.

As is also seen from a study of FIG. 2, an interior surface 111 is defined on the body 110. The interior surface 111 is exposed to the reservoir 115, wherein the ink 60, when contained within the reservoir, is in contact with the interior surface. An exterior surface 113 is also defined on the body 110 of the inkjet pen 100 as is shown. The interior surface 111 and the exterior surface 113 can be oriented in parallel, spaced-apart, juxtaposed relation to one another as is also shown.

The inkjet pen 100 can also include the support member 140 which is described above. The support member 140 can include the support surface 141 defined thereon, as is also explained above. In one possible configuration, the support member 140 can be in the form of a basket or the like, which includes the substantially annular rim 143. The support member 140 can also include a deck 147 on which the support surface 141 is defined. The deck 147 and the rim 143 can be oriented in spaced-apart, juxtaposed, and substantially parallel orientation, as shown.

The support member 140 can also include at least one stave element 145 that is connected to both the rim 143 and the deck 147. That is, the stave element 145 can serve as a structurally connective element that ties together the rim 143 and the deck 147. At least one opening 149 can be defined between the rim 143 and the deck 147. It is seen that, when specifically configured as thus described above, the support element 140 can be sized to fit snugly into the aperture 120, wherein the rim 143 rests on the exterior surface 113 of the body 110, while the deck 147 is suspendably supported from the rim within the reservoir 115.

Figure 3:
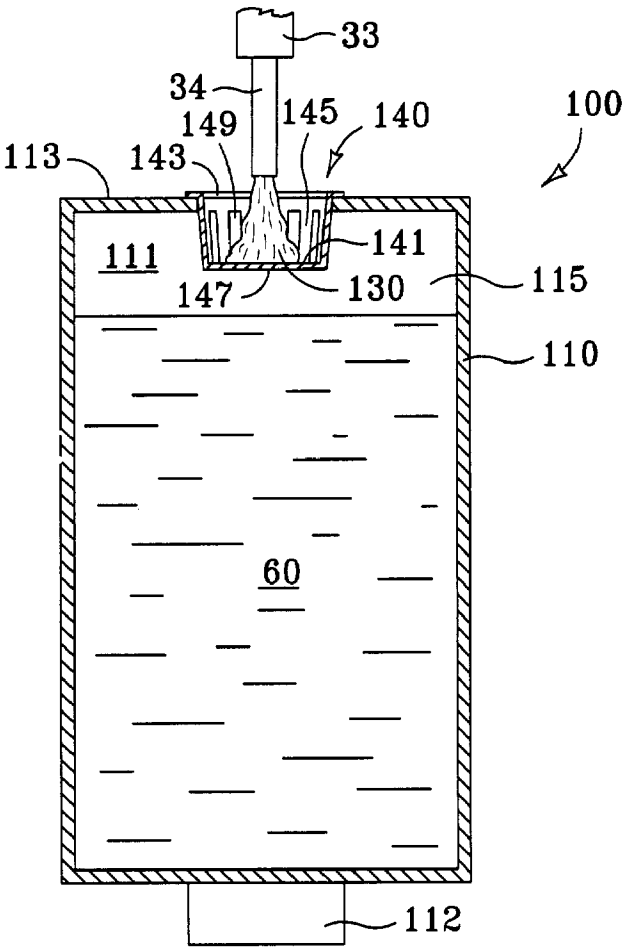
FIG. 3 is another side elevation sectional view of the inkjet pen depicted in FIG. 2, but with the support member installed within the vent aperture.

This is illustrated more specifically in FIG. 3, which is another side elevation sectional view in which the inkjet pen 100 in accordance with one embodiment of the invention is depicted. As is seen, the support member 140 is shown fully installed within the body 110. When the support member 140 is thus installed, the support surface 141 can be oriented in substantially parallel, spaced-apart, juxtaposed relation to at least a portion of the interior surface 111 of the body 110. As is also seen, at least one opening 149 can be located within the reservoir 115 when the support member 140 is in the installed position.

With the support member 140 in the installed position, as shown, the expandable foam 130 can be dispensed onto the support surface 141. For example, the nozzle 34 can be placed above the support surface 141, whereupon the valve 33 is opened, thereby releasing the expandable foam 130 onto the support surface. When so dispensed, the expandable foam 130 can be in a substantially flowable state as is described above. A predetermined quantity of expandable foam 130 can be dispensed onto the support surface 141, wherein the expandable foam can expand to a predetermined size when curing.

Figure 4:
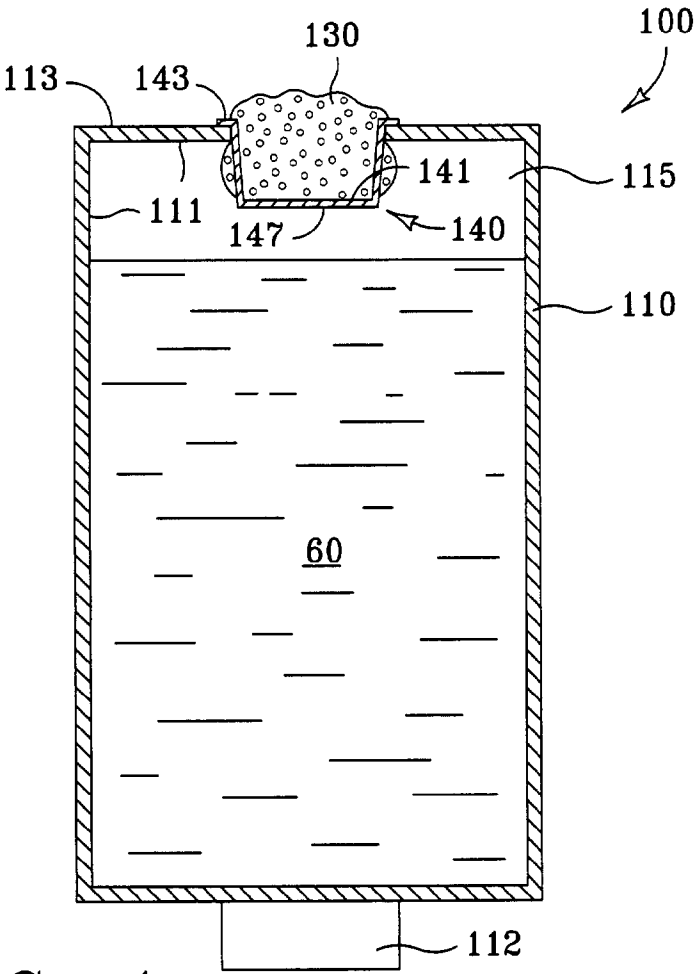
FIG. 4 is a side elevation sectional view of the inkjet pen depicted in FIG. 3, but with the expandable foam installed in the vent aperture.

Moving now to FIG. 4, another side elevation sectional view is shown in which the inkjet pen 100 is depicted in accordance with one embodiment of the present invention. As seen, the expandable foam 130 has been dispensed and has substantially fully expanded. A close examination of FIG. 4 reveals that a portion of the expandable foam 130 has expanded through the openings 149 (shown in FIGS. 1 through 3), wherein, when fully cured, the expandable foam is substantially trapped between the support surface 141 of the support member 140 and the interior surface 111 of the body 110. As can be appreciated, this can serve to substantially secure the expandable foam 130 within the aperture 120 (shown in FIGS. 1 and 2).

Figure 5:
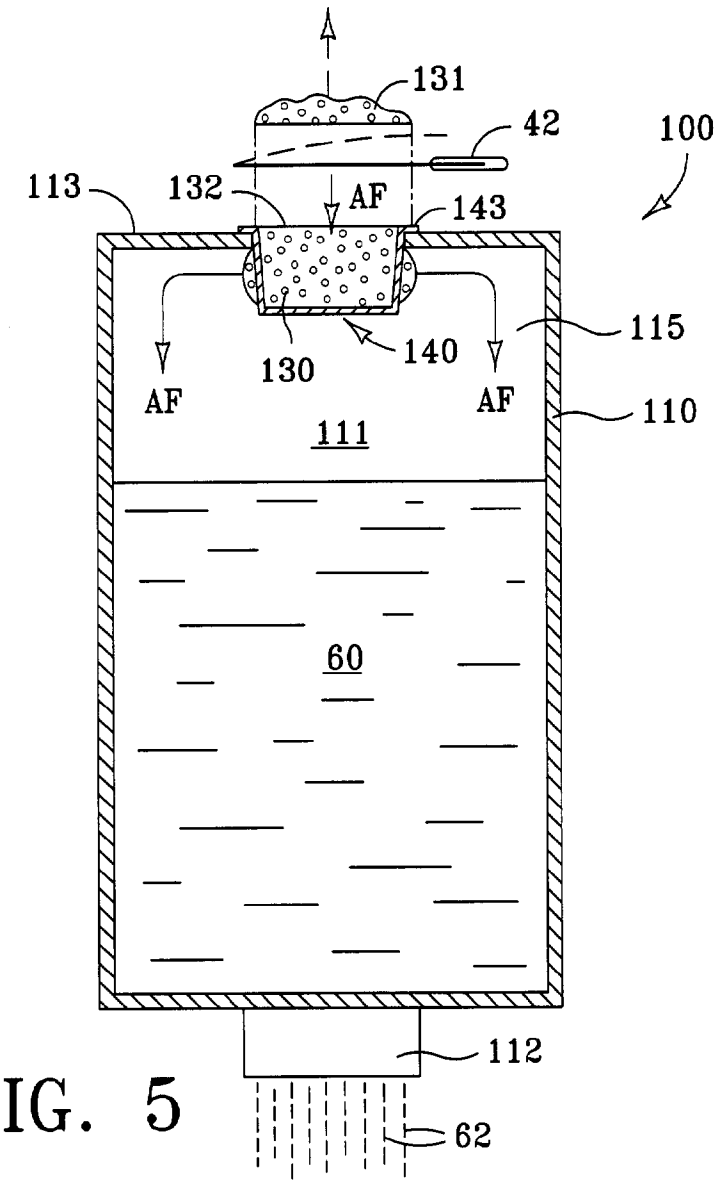
FIG. 5 is another side elevation sectional view of the inkjet pen depicted in FIG. 4, but with the expandable foam shown to be trimmed.

Proceeding to FIG. 5, another side elevation sectional view is shown in which the inkjet pen 100 is depicted in accordance with one embodiment of the invention. Once the expandable foam 130 is substantially cured such that it is substantially rigid, the expandable foam can be trimmed. This trimming of the expandable foam 130 can be accomplished by employment of a trimming device 42 such as a knife blade or the like. More specifically, the trimming device 42 can be employed to trim a waste portion 131 from the expandable foam 130 as shown. Such a trimming procedure can serve to improve the appearance of the expandable foam 130 by providing a substantially flat, trimmed surface 132.

Still referring to FIG. 5, the expandable foam 130, when installed and substantially cured, can serve to prevent the ink 60 within the reservoir 115 from leaking therefrom through the aperture 120 (shown in FIGS. 1 and 2). Furthermore, the expandable foam 130 can serve to allow airflow AF to enter therethrough and into the reservoir 115. Such venting of the reservoir 115 can serve 10 facilitate the operation of the inkjet pen 100 by allowing entering air to displace the ink 60 within the reservoir 115 as droplets 62 of ink are projected from the print head 112. The firing of the droplets 62 of ink 60 from the print head 112 results in a falling level of ink 60 within the reservoir 115.

Figure 6:
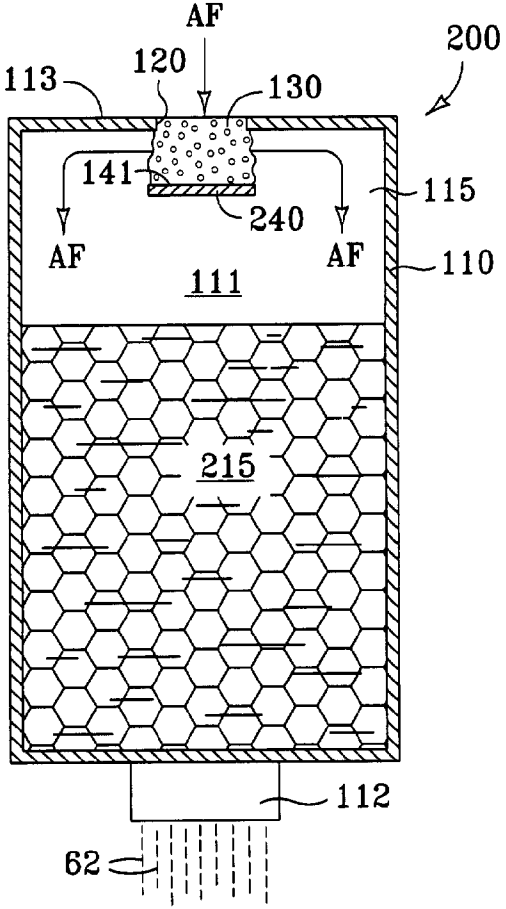
FIG. 6 is a side elevation sectional view in which an inkjet pen is depicted in accordance with another embodiment of the present invention.

Now turning to FIG. 6, another side elevation sectional view is shown in which an inkjet pen 200 is depicted in accordance with another embodiment of the present invention. As is seen, the inkjet pen 200 includes a body 110 which is described above with respect to the inkjet pen 100. An aperture 120 is defined through the body 110 as is also described above with respect to the inkjet pen 100. The inkjet pen 200 can also include a print head 112 that can be supported by the body 110 as is further described above with respect to the inkjet pen 100.

The body 110 of the inkjet pen 200 defines a substantially enclosed reservoir 115 as described above with respect to the inkjet pen 100. However, the inkjet pen 200 can also include a capillary reticulate material 215 that is disposed within the reservoir 115. Capillary reticulate material such as the capillary reticulate material 215 is known in the art and is often employed in conjunction with inkjet pens in the general manner depicted, wherein the capillary reticulate material provides certain beneficial ink control attributes in connection with the operation of the pen. In any case, the capillary reticulate material 215 is configured to contain a quantity of liquid ink (not shown).

As is further shown, the inkjet pen 200 includes a quantity of expandable foam 130 that is disposed within the aperture 120. The expandable foam 130 is described above with respect to the inkjet pen 100. Specifically, the expandable foam 130 is configured to substantially prevent the flow of liquid ink therethrough and out of the reservoir 115, while also allowing airflow AF therethrough and into the reservoir.

As is further seen, the support member 240 can have a substantially different form from that of the support member 140 which is discussed above with respect to the inkjet pen 100. That is, the support member 240 can be in the form of a substantially flat shelf or the like as depicted in FIG. 6. The support member 240 can be supported by the body 110, as is also shown. The support surface 141 can be defined on the support member 240. The support surface is configured to support the expandable foam 130 as is described above, and as is shown in FIG. 6.

Figure 7:
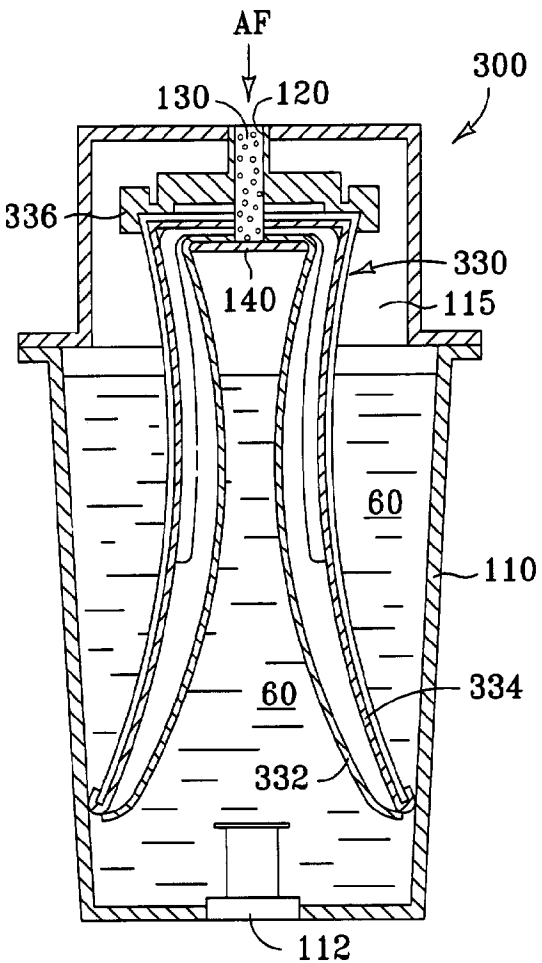
FIG. 7 is a side elevation sectional view in which an inkjet pen is depicted in accordance with yet another embodiment of the present invention.

Moving now to FIG. 7, a side elevation sectional view is shown in which an ink-jet pen 300 is depicted in accordance with a further embodiment of the invention. The ink-jet pen 300 includes a body 110 that defines an ink reservoir 115. The reservoir 115 is configured to contain a quantity of liquid ink 60. The body 110 and the ink reservoir 115 are described above, along with the vent aperture 120.

The inkjet pen 300 also includes an air pressure control bag assembly 330. Air pressure control bag assemblies are generally known in the art. The air pressure control bag assembly 330 includes an air pressure control bag 332. Other various components such as a spring assembly 334 and a hanger assembly 336 can be included in the air pressure control bag assembly 330. The spring assembly 334 can function to facilitate the operation of the air pressure control bag 332, while the hanger assembly 336 is configured to support the air pressure control bag 332 from the body 110 of the ink-jet pen 300.

A vent aperture 120 is defined through the body 110 as described above with respect to previously discussed embodiments. Specifically, the vent aperture 120 is configured to facilitate air flow AF from an ambient location outside of the body 110 and into the air pressure control bag 332. Such migration of air into the air pressure control bag 332 facilitates the operation of the inkjet pen 300 by displacing the ink 60 that is removed from the reservoir by operation of the print head 112.

The inkjet pen 300 also includes a quantity of expandable foam 130 that is operatively disposed within the aperture 120. The inkjet pen 300 can include a support member 140 on which the expandable foam 130 can be supported as is shown. The expandable foam 130 is described above with respect to the previously discussed embodiments. Specifically, the expandable foam 130 can serve to control the rate of airflow AF through the aperture 120 during operation of the inkjet pen 300. That is, the expandable foam 130 can serve to meter the rate at which the airflow AF passes through the aperture 120 to enter the air pressure control bag 332.

Furthermore, the expandable foam 130 can serve to prevent contaminants and the like from entering the reservoir 115. More specifically, the expandable foam 130 can serve to prevent contaminants and the like from entering the air pressure control bag 332. That is, the expandable foam 130 can act as a filter to remove contaminants from the airflow AF before the airflow enters the reservoir 115.

Figure 8:
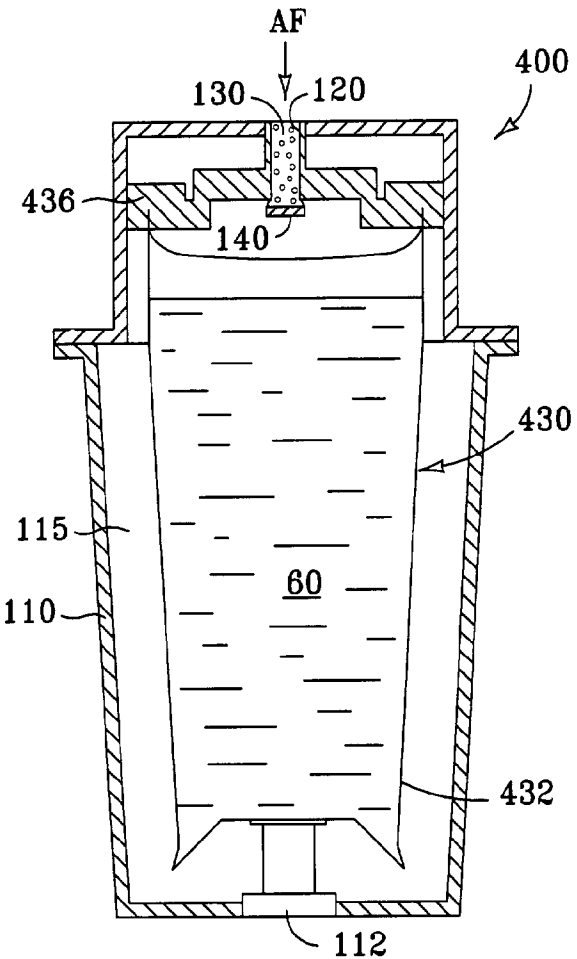
FIG. 8 is a side elevation sectional view in which an inkjet pen is depicted in accordance with still another embodiment of the present invention.

With reference now to FIG. 8, another side elevation sectional view is shown in which an inkjet pen 400 is depicted in accordance with another embodiment of the invention. As is seen, the inkjet pen 400 includes a body 110 that defines a reservoir 115. The body 110 defines therethrough a vent aperture 120. The aperture 120 is configured to facilitate the entrance of airflow AF into the reservoir 115 from an ambient location outside the body 110.

The inkjet pen 400 also includes an ink bladder assembly 430. Ink bladder assemblies are generally known in the art. The ink bladder assembly 430 can include an ink bladder 432 that is configured to contain a quantity of liquid ink 60. The ink bladder assembly 430 can also include a hanger assembly 436 that is configured to support the ink bladder 432. That is, the ink bladder 432 is supported by the body 110, and can be so supported by way of the hanger assembly 436.

The inkjet pen 400 also includes a quantity of expandable foam 130 that is operatively disposed within the aperture 120 as shown. The inkjet pen 400 can also include a support member 140 on which the expandable foam 130 can be supported as is seen. The expandable foam 130 is configured to function in a manner similar to that explained above with respect to the inkjet pen 300. That is, the expandable foam 130 can be configured to act as a metering device to control the rate of airflow AF into the reservoir 115 as the ink 60 is depleted from the ink bladder 432. Additionally, or in the alternative, the expandable foam 130 can serve as a filter to remove particulate contaminants from the airflow AF before the airflow enters the reservoir 115.

Figure 9:
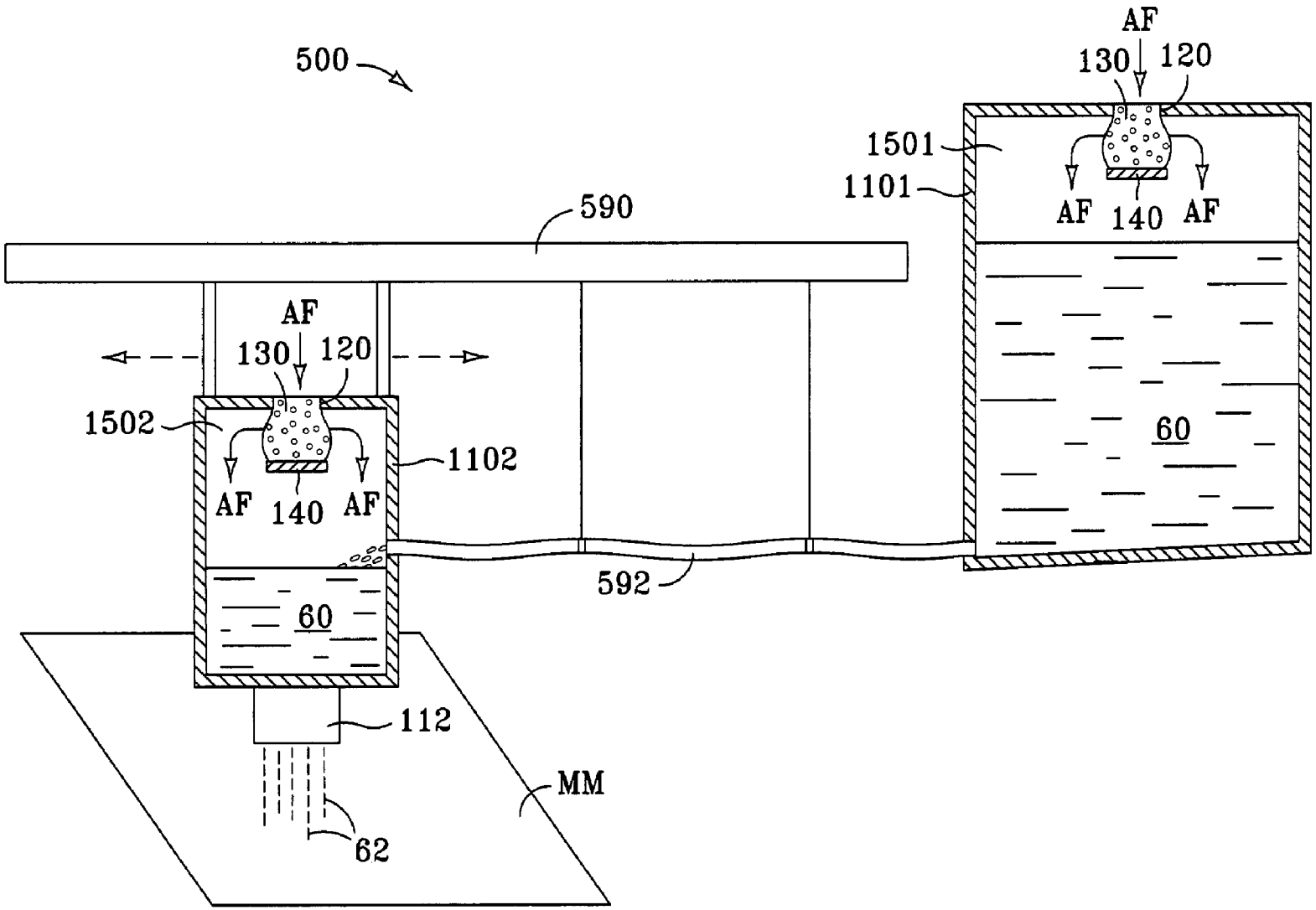
FIG. 9 is a side elevation sectional view in which an inkjet pen is depicted in accordance with an additional embodiment of the present invention.

Turning to FIG. 9, another side elevation sectional view is shown in which an inkjet pen 500 is depicted in accordance with another embodiment of the invention. The inkjet pen 500 can include a stationary body 1101, and/or a movable body 1102. The stationary body 1101 defines a substantially enclosed primary reservoir 1501 that is configured to contain a quantity of liquid ink 60. The movable body 1102 also defines a substantially enclosed secondary reservoir 1502 that is configured to also contain a quantity of ink 60 as shown. The secondary reservoir 1502 can be substantially smaller in size that the primary reservoir 1501.

The movable body 1102 is movably supported by a positioning assembly 590. The positioning assembly 590 is configured to movably support the movable body 1102 and to selectively position the movable body relative to a sheet of media MM, or the like. The inkjet pen 500 also includes an ink conduit 592 that fluidly connects the primary reservoir 1501 with the secondary reservoir 1502. That is, the ink conduit 592 serves to convey ink 60 from the primary reservoir 1501 to the secondary reservoir 1502.

The inkjet pen 500 can also include a print head 112 that can be supported by the movable body 1102 as shown. The print head 112 is discussed above, and is generally employed to draw ink 60 from the secondary reservoir 1502 and to selectively project droplets 62 of ink onto the media MM as the movable body 1102 is movably supported by the positioning assembly 590. That is, the print head 112 functions to selectively fire the droplets 62 of ink 60 onto the media MM to form a predetermined pattern thereon. The ink 60 is drawn into the print head 112 from the secondary reservoir 1502. As the ink 60 is depleted in this manner from the secondary reservoir 1502, additional ink is conveyed thereto from the primary reservoir 1501 so as to re-supply the secondary reservoir.

As is also seen from a study of FIG. 9, at least one of the stationary body and the movable body define therethrough a vent aperture 120. That is, at least the stationary body 1101 can define therethrough an aperture 120, while another aperture can also be defined through the movable body 1102 as shown. As is further seen, a quantity of expandable foam 130 is disposed within the aperture 120, thereby substantially preventing the flow therethrough of liquid ink 60, while also allowing airflow AF therethrough. The function of the airflow AF is discussed above with respect to the previously described embodiments.

The inkjet pen 500 can further include a support member 140. The support member 140 has been described above with respect to the previously discussed embodiments. The support member 140 can be disposed within either the primary reservoir 1501 or the secondary reservoir 1502, or both reservoirs as depicted. The support member 140 can serve to support the expandable foam 130 as is shown and as is explained above with respect to the previously discussed embodiments.

A method in accordance with a further embodiment of the invention can includes steps for installing a vent plug into a vent aperture that is defined through the body of an inkjet pen. For example, the body 110 having the aperture 120 defined therethrough as shown in FIGS. 1 through 8 can be considered for illustrative purposes. The method includes providing an expandable foam material in a substantially flowable state and dispensing the expandable foam material into the aperture. For example, the expandable foam 130 which is shown in FIGS. 1 through 9 can also be considered for illustrative purposes.

The method can also include allowing the expandable foam material to cure into a substantially rigid state, wherein the substantially rigid expandable foam substantially blocks liquid flow through the aperture. The cured expandable foam can also allow at least some gas flow therethrough. That is, the cured substantially rigid expandable foam can block the flow of liquid, such as ink, through the aperture while at the same time allowing at least some gas, such as air, to flow through the aperture. The method can further include trimming the cured expandable foam. The method can be illustrated with reference to FIG. 1, and/or with reference to FIGS. 2 through 5.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An inkjet pen, comprising:

a body that defines an enclosed reservoir configured to contain a liquid ink, wherein the body defines a vent aperture therethrough; and, a quantity of expandable foam that has been dispensed into the reservoir while in a substantially flowable state.

2. The inkjet pen of claim 1, further comprising a support member supported by the body within the reservoir, wherein the expandable foam has been dispensed onto the support member.

3. The inkjet pen of claim 1, and wherein the expandable foam comprises at least a portion of open cell content.

4. The inkjet pen of claim 1, and wherein the expandable foam comprises substantially entirely open cell content.

5. The inkjet pen of claim 1, and wherein the expandable foam comprises polyurethane foam.

6. The inkjet pen of claim 1, wherein the body is a stationary body, and wherein the enclosed reservoir is a primary ink reservoir, the inkjet pen further comprising:

a movable body defining a secondary ink reservoir; and, an ink conduit fluidly connecting the primary ink reservoir to the secondary ink reservoir.

7. The inkjet pen of claim 1, wherein the body is a movable body, and wherein the enclosed reservoir is a secondary reservoir, the inkjet pen further comprising:

a stationary body defining a primary ink reservoir; and, an ink conduit fluidly connecting the primary ink reservoir to the secondary ink reservoir.

8. The inkjet pen of claim 1, and further comprising a capillary reticulate material disposed within the reservoir.

9. The inkjet pen of claim 1, and further comprising an air pressure control bag supported by the body and disposed within the reservoir, wherein the aperture allows air flow from an ambient location outside of the cartridge body into the air pressure control bag.

10. The inkjet pen of claim 1, and further comprising an ink bladder supported by the body and disposed within the reservoir.

11. An inkjet pen, comprising:

a body that defines an enclosed reservoir configured to contain a liquid ink, wherein the body defines a vent aperture therethrough;

a support member supported by the body within the reservoir and proximate the aperture, wherein an opening is defined between the support member and the body; and, a quantity of expandable foam disposed within the reservoir to completely cover the aperture, wherein at least a portion of the expandable foam protrudes through the opening, thereby trapping the expandable foam between the support member and the body; and wherein the support member is configured to be inserted into the aperture, and wherein the support member comprises:

a substantially annular rim configured to rest on the body proximate the aperture and substantially outside of the reservoir;

a deck, wherein the deck and the rim are oriented in spaced-apart, juxtaposed relation to one another, and wherein the deck is configured to be located substantially within the reservoir; and, a stave element connected to both the rim and to the deck, wherein an opening is defined there between, and wherein the opening is configured to allow the expandable foam to expand therethrough.

12. A method of installing a vent plug in a vent aperture defined through an inkjet pen body, the method comprising:

providing an expandable foam in an uncured, flowable state; and, dispensing the expandable foam, while in the uncured, flowable state, into the aperture.

13. The method of claim 12, and further comprising allowing the expandable foam to cure into a substantially rigid state, wherein the substantially rigid expandable foam completely covers the aperture.

14. The method of claim 13, and further comprising trimming the cured expandable foam.

15. An inkjet pen, comprising:

a body that defines an enclosed reservoir, wherein the body defines a vent aperture there through;

a deck supported by the body, the deck defining a support surface, wherein the support surface is located within the reservoir and oriented in substantially juxtaposed, spaced-apart registration with the aperture, thereby defining an opening between the deck and the body; and, a quantity of cured, rigid expandable foam supported on the support surface to completely cover the aperture.

16. The inkjet pen of claim 15, and wherein at least a portion of the expandable foam protrudes through the opening.

17. The inkjet pen of claim 15, and further comprising an interior surface defined on the pen body, wherein:

the interior surface is exposed to the reservoir; and, at least a portion of the expandable foam protrudes through the opening so as to be substantially trapped between the support surface and the interior surface.

18. A liquid container, comprising:

a body that defines an enclosed reservoir, wherein the body defines a vent aperture therethrough;

a support member supported by the body within the reservoir and proximate the aperture, wherein an opening is defined between the support member and the body; and, a quantity of expandable foam disposed within the reservoir to completely cover the aperture, wherein at least a portion of the expandable foam protrudes through the opening, thereby trapping the expandable foam between the support member and the body.

19. The liquid container of claim 18, and wherein the support member comprises a deck defining thereon a support surface, wherein the support surface is located within the reservoir and oriented in substantially juxtaposed, spaced-apart registration with the aperture, whereby the expandable foam is located substantially between the support surface and the aperture.

20. The liquid container of claim 19, and further comprising an interior surface defined on the pen body, wherein:

the interior surface is exposed to the reservoir; and, at least a portion of the expandable foam is trapped between the support surface and the interior surface.

21. A liquid containment means, comprising:

a body that defines an aperture therethrough, and that encloses a reservoir;

a support means located within the reservoir; and, a quantity of cured, rigid expandable foam within the reservoir and at least a portion of which expandable foam is trapped between the support means and the body to completely cover the aperture.

22. A method of installing a vent plug in a vent aperture defined through a liquid container body, the method comprising:

providing an expandable foam in an uncured, flowable state;

supporting the expandable foam, while in the uncured, flowable state, within the container body, and proximate the aperture; and, allowing the expandable foam to expand to completely cover the aperture.

23. The method of claim 22, and further comprising allowing the expanded expandable foam to cure into a rigid state.

24. The method of claim 22, and wherein the expanded expandable foam is larger than the aperture, thereby preventing the removal of the expanded expandable foam from the aperture.

25. An inkjet pen, comprising:

a body that defines an enclosed reservoir configured to contain a liquid ink, wherein the body defines a vent aperture therethrough;

a print head supported on the body;

a quantity of expandable foam disposed within the aperture, thereby substantially preventing the flow therethrough of the liquid ink, and wherein the expandable foam is configured to allow air to flow therethrough; and, a support member configured to support thereon the expandable foam, wherein:

the support member defines thereon a support surface configured to supportively contact the expandable foam;

the support member is configured to be inserted into the aperture;

the support member comprises:

a substantially annular rim configured to rest on the body proximate the aperture and substantially outside of the reservoir;

a deck on which the support surface is defined, wherein the deck and the rim are oriented in spaced-apart, juxtaposed relation to one another, and wherein the deck is configured to be located substantially within the reservoir; and, a stave element connected to both the rim and to the deck, wherein an opening is defined therebetween, and wherein the opening is configured to allow the expandable foam to expand therethrough.

26. An inkjet pen, comprising:

a body that defines a substantially enclosed reservoir configured to contain a liquid ink, wherein the body defines a vent aperture therethrough; and, a quantity of expandable foam disposed within the aperture, thereby substantially blocking ink flow through the aperture.

27. The inkjet pen of claim 26, wherein the expandable foam has been dispensed into the reservoir in a substantially flowable state.

28. The inkjet pen of claim 27, wherein the expandable foam has cured into a substantially rigid state.

* * * * *

UNITED STATES PATENT AND TRADEMARK OFFICE

CERTIFICATE OF CORRECTION

PATENT NO. : 7,188,940 B2
APPLICATION NO. : 10/356779
DATED : March 13, 2007
INVENTOR(S) : Ari Feliciano It is certified that error appears in the above-identified patent and that said Letters Patent is hereby corrected as shown below:

On the face page, in field (73), under "Assignee", in column 1, line 2, delete "LP." and insert -- L.P. --, therefor.

In column 5, line 24, delete "(riot shown)" and insert -- (not shown) --, therefor.

In column 6, line 58, after "server" delete "10" and insert -- to --, therefor.

Signed and Sealed this

Second Day of December, 2008

JON W. DUDAS
*Director of the United States Patent and Trademark Office*